US005284097A

United States Patent [19]

Peppin et al.

[11] Patent Number: 5,284,097

[45] Date of Patent: Feb. 8, 1994

[54] BALLAST DISTRIBUTION, REGULATION AND RECLAIMING RAILROAD MAINTENANCE DEVICE

[75] Inventors: Richard A. Peppin, Minnetonka; Robert G. Vieau, Plymouth; James S. Bell, Brooklyn Park, all of Minn.

[73] Assignee: Loram Maintenance of Way, Inc., Hamel, Minn.

[21] Appl. No.: 786,332

[22] Filed: Oct. 31, 1991

Related U.S. Application Data

[63] Continuation-in-part of Ser. No. 605,998, Oct. 31, 1990, abandoned.

[51] Int. Cl.[5] ..... B61D 7/02

[52] U.S. Cl. ..... 105/311.1; 105/286; 298/35 M; 246/187 A; 104/88

[58] Field of Search ..... 246/187 A, 187 B; 105/311.1, 286, 287, 240, 241.2; 298/35 M; 104/88

[56] References Cited

U.S. PATENT DOCUMENTS

| | | | |
|---|---|---|---|
| 3,295,704 | 1/1967 | Gillick et al. | 105/311.1 |
| 3,446,373 | 5/1969 | Keister, Jr. et al. | 105/311.1 |
| 3,579,873 | 5/1971 | Kershaw . | |
| 3,596,565 | 8/1971 | Atkinson | 105/240 |
| 3,612,184 | 10/1971 | Plasser . | |
| 3,677,191 | 7/1972 | Nagy . | |
| 3,706,145 | 12/1972 | Bucksch et al. . | |
| 3,877,160 | 4/1975 | Plasser et al. . | |
| 4,013,017 | 3/1977 | Toyota et al. | 105/311.1 |
| 4,226,750 | 4/1992 | Rosenbaum | 298/35 M |
| 4,227,324 | 10/1980 | Theurer . | |
| 4,249,325 | 2/1981 | Theurer . | |
| 4,370,819 | 2/1988 | Ingram . | |
| 4,425,969 | 1/1984 | Naggar . | |
| 4,707,935 | 11/1987 | Cicin-Sain . | |
| 4,742,628 | 5/1988 | Cicin-Sain . | |
| 4,760,130 | 4/1988 | Prius | 105/241.2 |
| 4,835,887 | 6/1989 | Theurer . | |
| 5,012,749 | 5/1991 | Passage, Jr. | 246/187 A |

FOREIGN PATENT DOCUMENTS

| | | | |
|---|---|---|---|
| 229582 | 10/1968 | U.S.S.R. | 105/311.1 |
| 476814 | 10/1977 | U.S.S.R. | 105/311.1 |
| 582121 | 11/1977 | U.S.S.R. | 105/311.1 |
| 664865 | 5/1979 | U.S.S.R. | 105/311.1 |
| 724328 | 1/1980 | U.S.S.R. | 105/311.1 |
| 2194982 | 3/1988 | United Kingdom . | |

*Primary Examiner*—Eric K. Nicholson
*Assistant Examiner*—Spencer Warwick
*Attorney, Agent, or Firm*—Patterson & Keough

[57] ABSTRACT

A railroad maintenance device distributes, regulates and reclaims ballast along a railway road bed. The device includes one or more hopper cars for transporting and depositing ballast, a regulating car including a track regulator, a shoulder regulator, and an extensible plow arm for reclaiming ballast deposited at a distance from the shoulder of the road bed. The hopper cars include radio controlled gates for the remote control of ballast depositing operations, and a computer controlled system for optimizing the distribution of ballast according to predetermined parameters. A bucket elevator is located rearwardly of the track regulator for lifting excess ballast from the road bed, and a belt conveyor transports the lifted ballast to a hopper car.

8 Claims, 14 Drawing Sheets

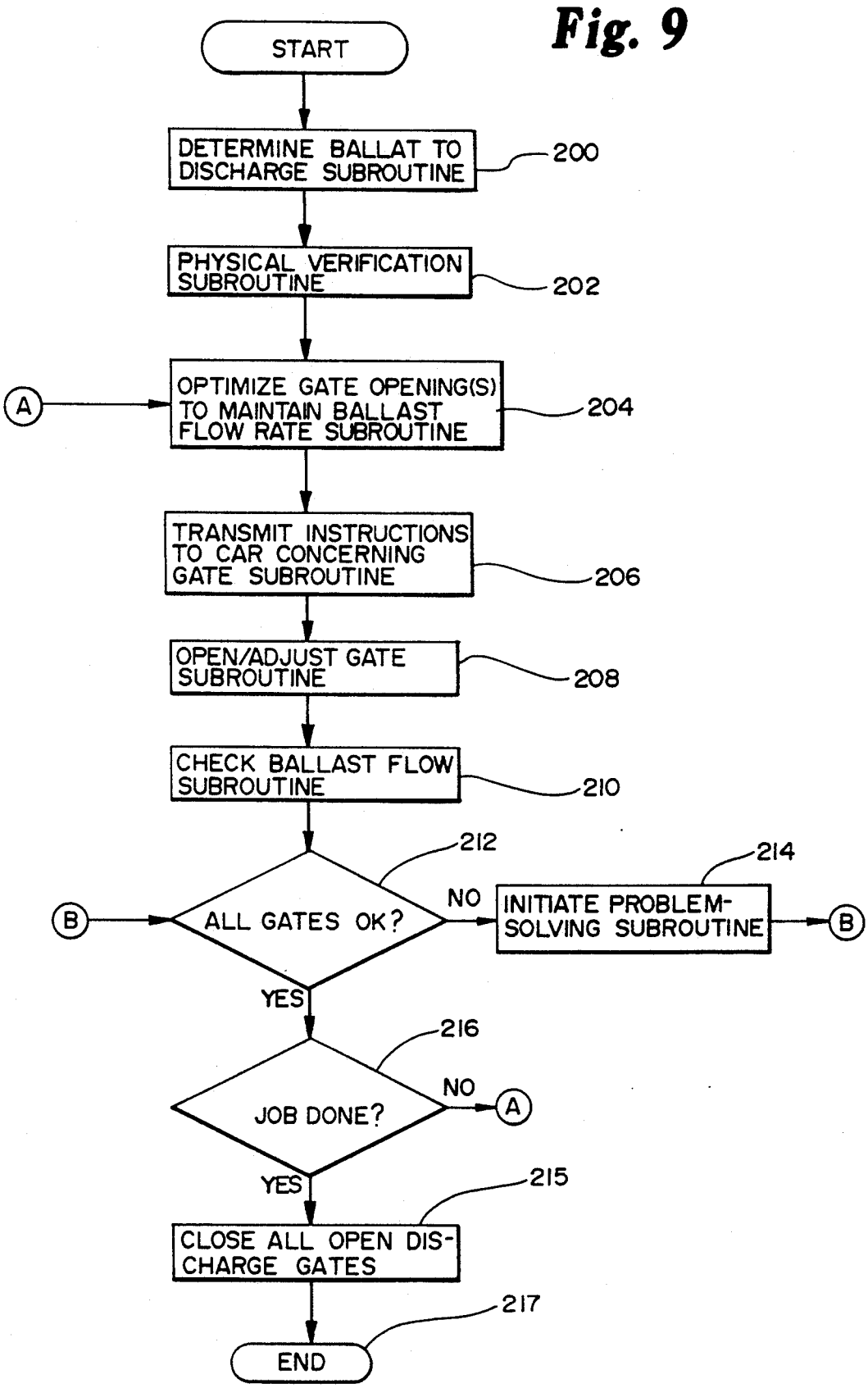
Fig. 9
START
DETERMINE BALLAT TO DISCHARGE SUBROUTINE
200
PHYSICAL VERIFICATION SUBROUTINE
202
A
OPTIMIZE GATE OPENING(S) TO MAINTAIN BALLAST FLOW RATE SUBROUTINE
204
TRANSMIT INSTRUCTIONS TO CAR CONCERNING GATE SUBROUTINE
206
OPEN/ADJUST GATE SUBROUTINE
208
CHECK BALLAST FLOW SUBROUTINE
210
212
B
ALL GATES OK?
NO
214
INITIATE PROBLEM-SOLVING SUBROUTINE
B
YES
216
JOB DONE?
NO
A
YES
215
CLOSE ALL OPEN DIS-CHARGE GATES
217
END

BALLAST DISTRIBUTION, REGULATION AND RECLAIMING RAILROAD MAINTENANCE DEVICE

This is a continuation in part of U.S. patent application Ser. No. 605,998 filed Oct. 31, 1990 now abandoned.

TECHNICAL FIELD

This invention pertains to an apparatus for maintaining railway road beds. In particular, it pertains to equipment for maintaining the ballast used to support the rails and ties of a railway road bed, and a computer-directed control system for remotely actuating the discharge doors of ballast-carrying railroad hopper cars for the controlled distribution of ballast on to a railway road bed.

BACKGROUND ART

Railway road beds must be capable of supporting extremely heavy rolling stock. Road beds have traditionally included closely spaced railroad ties for supporting the railroad rails. The ties in turn are supported by ballast comprising essentially debris-free rock through which rain water can quickly drain.

Maintenance of the ballast in a railway road bed is of primary concern in extending the usefulness of the railway road bed. The ballast must be periodically cleaned to remove mud and debris that accumulates in the ballast and which would otherwise block the drainage of rain water from the railway road bed. Additionally, the quality of a railroad track is closely related to the levelness of the track. The ballast must be periodically tamped or blown underneath the railroad ties to true the level of the track.

Maintenance of a railway road bed by cleaning or tamping the track bed often requires the addition of ballast to the bed. Adding ballast to the track bed by conventional means is a time-consuming, labor intensive, and logistically difficult operation requiring several different crews and the scheduling of several different pieces of maintenance equipment. Additional ballast is initially deposited along the railroad track bed by a ballast car having hoppers for transporting and operating at the appropriate point to deposit ballast. A second crew then passes along the railroad track with a ballast regulating car that distributes the ballast on the railway track bed and picks up excess ballast. Finally, in situations where the excess ballast is too much to reclaim, or is distributed outside the reach of the regulating and reclaiming car, ballast is formed into windrows spaced apart from the railway road bed.

Ballast is discharged from the ballast-carrying hopper cars by a crew member who walks beside the ballast cars. The crew member uses a long metal lever that is placed in a tube attached to the discharge door to be opened or closed. The crew member, while walking along side the moving ballast car, pushes the lever up or down to pivot the door open or closed. The doors are generally oriented directly above a rail and include a chute or chutes that can be pivoted to either side of the rail for depositing ballast to the field side or the gauge side of the rail.

Frequently, when a crew member moves the lever back to its original position to close a discharge door, pieces of ballast become wedged in the opening between the hopper discharge gate and the discharge door. The crew member must push the lever quickly up and down moving the discharge door just enough to free the ballast and close the door before any more ballast becomes wedged. As a crew member works to unblock the discharge door excess ballast may be discharged resulting in the waste of some ballast. Moreover, pushing the lever up and down is physically demanding and the crew member must pay strict attention to safety as he walks along side the moving train. Operation of the ballast discharge doors is particularly dangerous when a hopper door must be quickly closed prior to the ballast car transmitting across a bridge, switch track or other obstacles.

It will also be appreciated that clouds of dust often obscure the ballast car and make an accurate calculation of the amount of ballast discharged through any hopper door over a particular section of rail very difficult to determine. The clouds of dust and noise of ballast discharging make it difficult for crew members to communicate with one another. The inability to readily communicate leads to confusion and inefficient use of manpower.

A railway maintenance system that could deposit ballast, distribute the ballast, and reclaim excess ballast, including excess ballast that would otherwise have to be formed into windrows, would provide decided advantages to the railroad maintenance industry in terms of scheduling, manpower, and ballast wastage. Moreover, a ballast maintenance system that, with limited manpower, could automatically calculate the amount of ballast necessary to maintain the railway, discharge that ballast through remote control of motorized ballast discharge doors, and automatically pinpoint any problems encountered during the process, would greatly enhance the safety and efficiency of railroad ballast distribution operations.

SUMMARY OF THE INVENTION

The ballast distribution, regulation, and reclaiming railroad maintenance device hereof provides for the distribution, regulation, and reclaiming of ballast in a single operation. The equipment broadly includes one or more ballast cars, a regulating and reclaiming car, and a power car for moving the equipment along a railway road bed. The ballast cars include remotely actuated ballast unloading gates. The regulating and reclaiming car includes reclaim wing plows, a track regulator, and shoulder regulators on each side of the car, and a bucket elevator and belt conveyor for transporting reclaimed ballast to a ballast hopper.

The present invention provides a computer-directed control system for calculating and remotely controlling the discharge of ballast from railroad ballast hopper cars in the course of railroad maintenance. The computer-directed control system includes a computer system with a custom computer program for coordinating the discharge of ballast, a radio transmission and reception system for remote activation of ballast unloading gates, and a data feedback system for monitoring the discharge of ballast and for identifying and solving problems therein. A unique communications protocol is provided to ensure positive control over the selection of which of a plurality of discharge doors are actuated at any given time, while minimizing the requirement for communications hardware.

An alternative, semi-automatic control system is also disclosed that provides for remote actuation of ballast discharge doors by an operator carrying a portable transmitter. The portable transmitter provides for the selection of a desired ballast car by number, and includes individual actuation switches for operating the discharge doors of the selected ballast car one at a time.

BRIEF DESCRIPTION OF THE DRAWINGS

FIG. 9 is a logical flow chart depicting the principal steps of the computer directed control system for the remote actuation of the ballast discharge doors;

DETAILED DESCRIPTION OF THE INVENTION

Figure 1A:
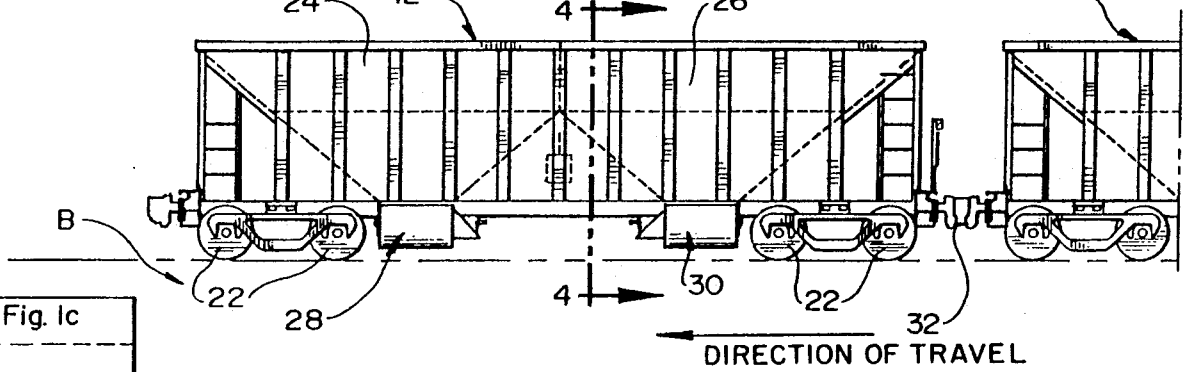
FIGS. 1 and 1a–1c are side elevational views of a ballast distribution, regulation, and reclaiming railroad maintenance device in accordance with the present invention.
Figure 2A:
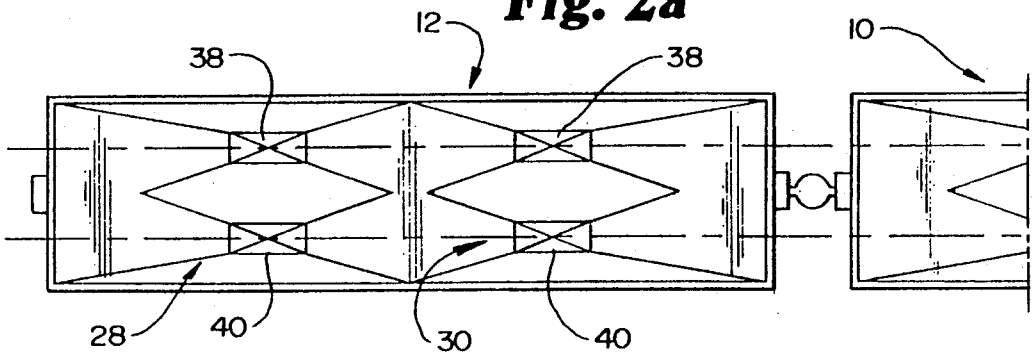
FIGS. 2 and 2a–2c are top plan views thereof.

Referring to the drawings, a ballast distribution, regulation, and reclaiming railroad maintenance device 10 in accordance with the present invention broadly includes a plurality of ballast hopper cars 12, 14, 16, a regulating and reclaim car 18, and a power car 20. As indicated by the arrow in FIG. 1, the direction of travel during the ballast distribution process is from the right to left of FIG. 1, with the ballast hopper car 12 at the front of the device 10, and the power car 20 at the rear of the device. While only three ballast hopper cars 12, 14, 16 are depicted in the figures, it will be understood that more than three cars could be used; it is typical to have as many as 60 ballast hopper cars in a single train. It will also be understood that a train could be made up of a plurality of ballast hopper cars and a power car 20, without employing a regulating and reclaim car 18.

The ballast cars 12, 14, 16 are supported along rails R of railroad track bed B by rail engaging wheels 22. Each ballast car 12, 14, 16 includes a front and rear hopper 24, 26 with associated front and rear ballast unloading gates 28, 30. The ballast cars 12, 14, 16 are detachably coupled to each other by coupling mechanisms 32, 34 and the rear ballast car 16 is detachably coupled to the regulating and reclaim car 18 by coupling mechanism 36.

Figure 4:
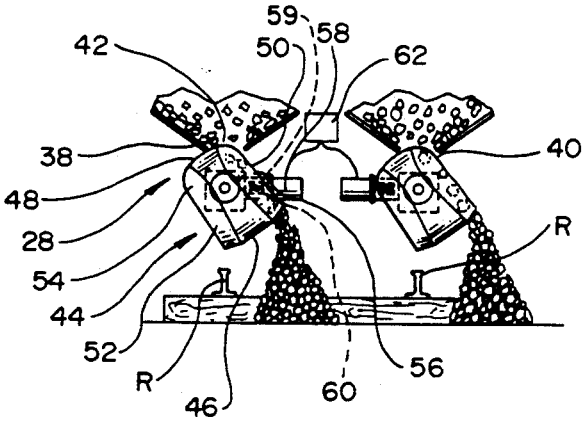
FIG. 4 is a fragmentary, sectional view taken along the line 4—4 of FIG. 1 with the ballast discharge doors depicted in the open position and ballast being discharged.
Figure 5:
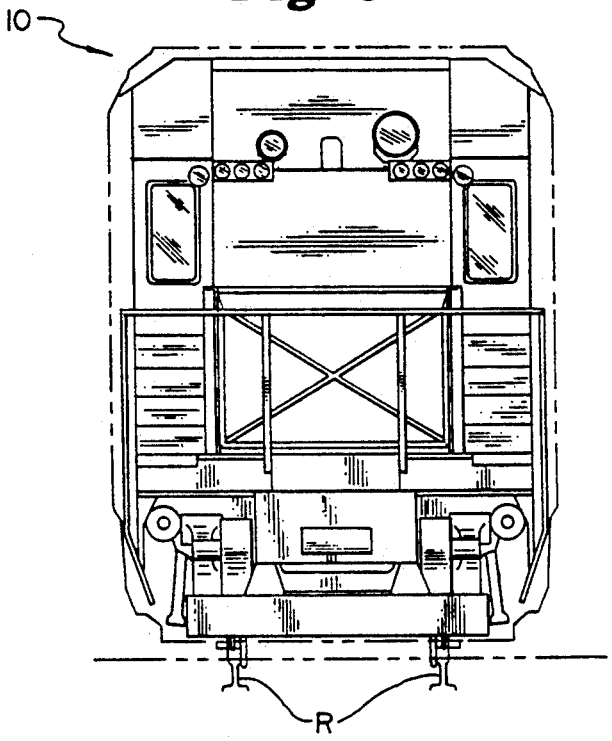
FIG. 5 is a rear elevational view of the device in accordance with the invention.

Referring to FIG. 4, ballast gates 28, 30 each include right and left gate assemblies 38, 40. Each of the gate assemblies 38, 40 includes a lowermost opening 42 on the right and left sides respectively of each of the front and rear hoppers 24, 26, a shiftable door 44, and ballast flow sensors 45. The sensors 45 preferably comprise a vibration sensor actuated by vibrations caused by the flow of ballast through its respective door 44. The doors 44 each comprise a pivotable member 46 having a top wall 48 and opposed sidewalls 50, 52. The sidewalls 50, 52 each include right and left ballast chutes 54, 56. Each door member 46 is coupled to an actuating motor 58 and motor shaft 59 by a worm gear 60. The gate assemblies 38, 40 and doors 44 may preferably comprise self-clearing door assemblies of the type described in co-pending U.S. patent application Ser. No. 725,025 filed Jul. 3, 1991, now abandoned, and assigned to the assignee of this application. A gate actuating radio receiver 62 is mounted on each ballast car 12, 14, 16, and electrical connections extend from the receiver 62 to each of the motors 58.

Regulating and reclaiming car 18 is supported along the rails R by rail engaging wheels 64. The frame 66 of the regulating and reclaiming car 18 supports right and left reclaim wing plows 68, 70, track regulator 72, right and left shoulder regulators 76, 78, bucket elevator 80, and belt conveyor 82.

The right and left reclaim wing plow 68, 70 are pivotally coupled to the frame 66 by respective pivot rods 84. The reclaim wing plows 68, 70 each comprise an articulated plowing arm 86. The plowing arms 86 include an inner member 88 pivotally coupled to a sleeve 89 carried by pivot rod 84, and an outer member 90 pivotally coupled to the inner member 88. Pivot rod 84 and sleeve 89 can be selectively shifted up and down, with sleeve 89 received within channel 91 of frame member 93. The inner member 88 includes pivoting clevis 92 for coupling the inner member 88 to the pivot rod 84, plowing face 94, and indirectly to pivot support 96. The outer arm 90 includes clevis 98 for pivotal coupling with the pivot support 96, and plowing face 100.

Track regulator 72 is a conventional track regulator designed for moving ballast from the shoulder of the railway road bed to the center line of the bed. The regulator 72 includes plow faces for engaging the ballast along the shoulder of the road bed and transporting the ballast over the rails R towards the center line along the regulator plow face as the regulator travels along the road bed.

Elevator 80 includes elevator housing 110, having lowermost ballast receiving port 112, and uppermost ballast discharge chute 114. A plurality of ballast holding buckets 116 are arranged along a conveyor chain 118. The elevator housing 110 can be shifted upwardly from the position depicted in FIG. 1 so as to disengage the opening 112 from receiving ballast into the housing 110. Moreover, the opening 112 may be provided with a door 119 to selectively permit the entry of ballast into the housing.

Figure 1:
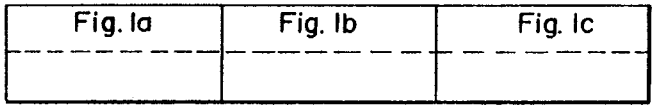
Figure 2:
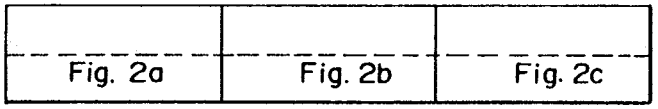
Figure 1B:
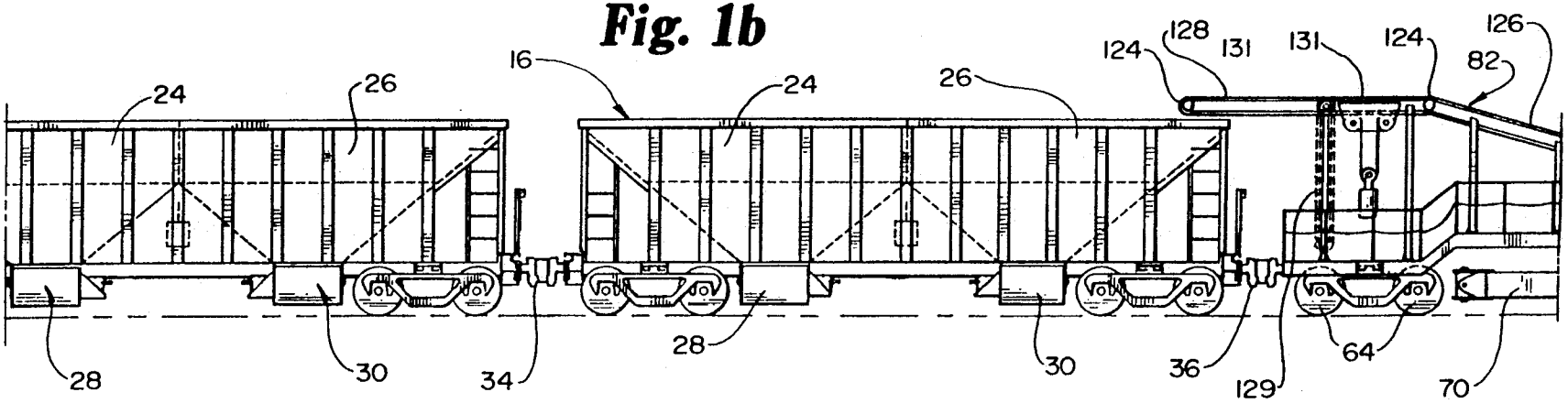
Figure 2B:
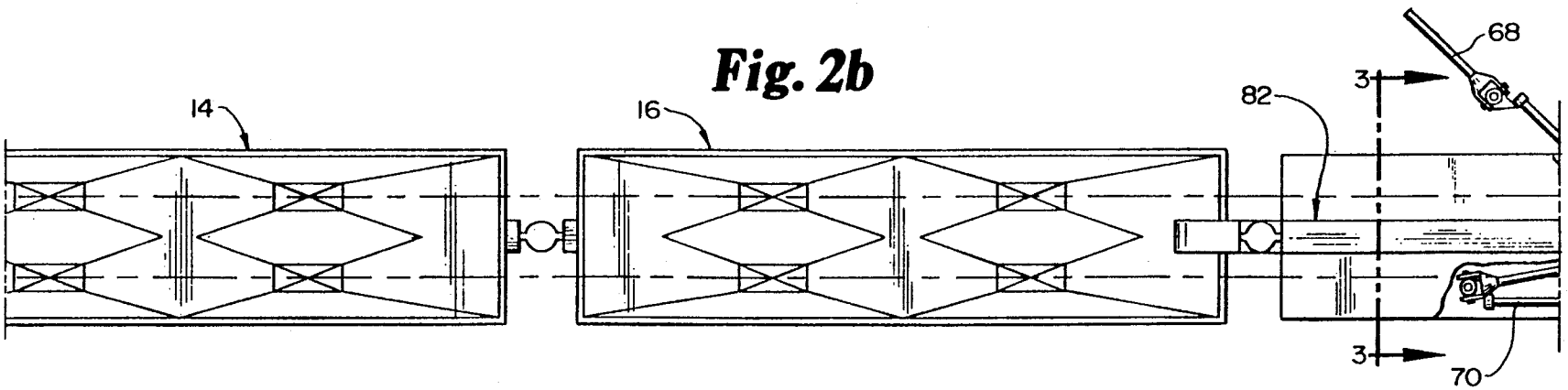
Figure 1C:
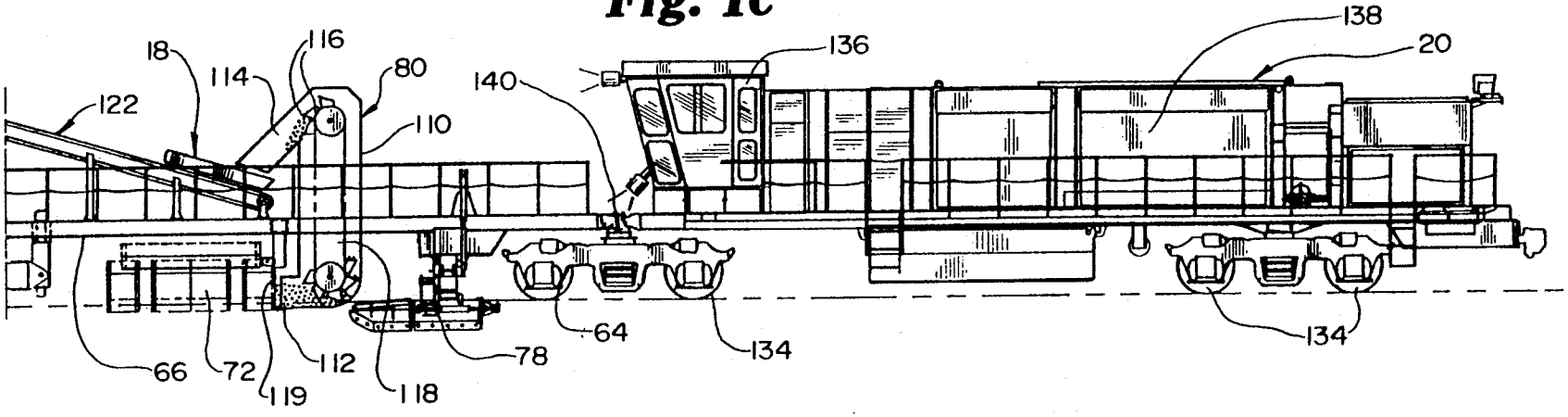
Figure 2C:
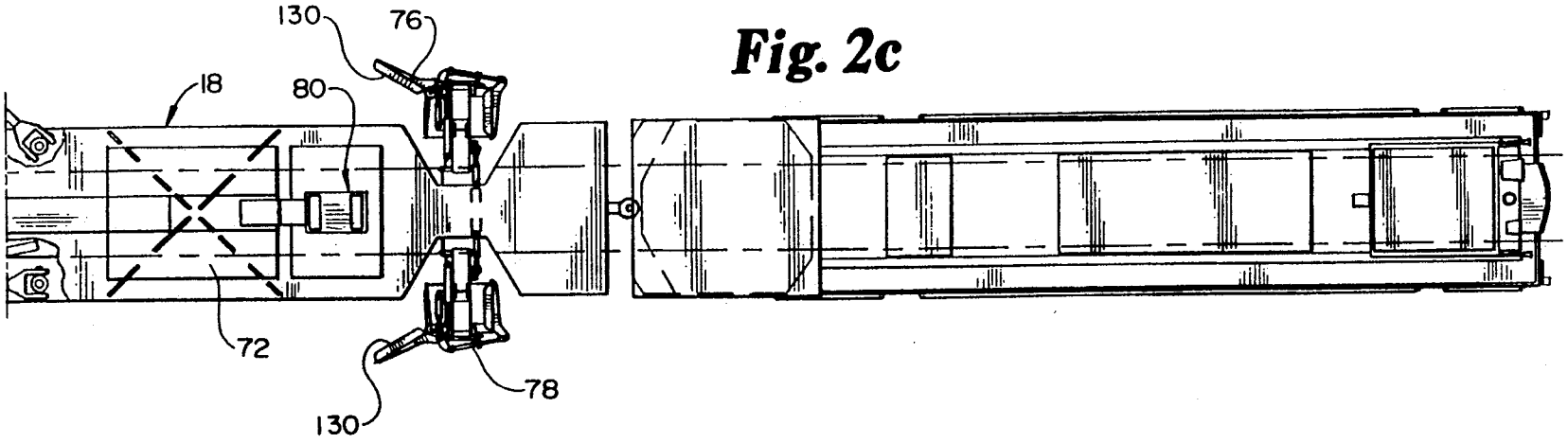
Figure 3:
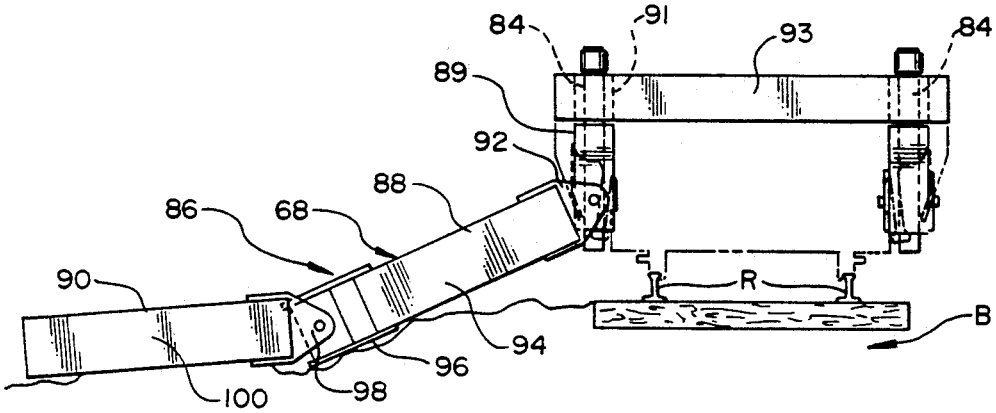
FIG. 3 is a fragmentary, sectional view taken along the line 3—3 of FIG. 2.

Belt conveyor 82 includes endless web 122 supported on rollers 124. The conveyor 82 includes an upwardly inclined portion extending from a point below the discharge chute 114 of the bucket elevator 80, and a level portion 128. The level portion can be stowed for transit in a vertical position, as depicted in FIG. 1 at 129. Gravity take up assembly 131 maintains the web 122 in a taut configuration when level portion 128 is in the stowed position.

Right and left shoulder regulators 76, 78 comprise conventional shoulder regulators for directing and leveling ballast along the shoulder of the railway road bed. The regulators 76, 78 each include an inwardly directed plow face 130.

Power car 20 is supported along the railroad track rail R by rail engaging wheels 134. The power cap 20 includes operator cab 136, engine compartment 138, and generator 139. The power car 20 is coupled to regulating car 18 by articulated coupling 140.

The generator 139 provides for a source of electrical power for the actuating motors 58, and for the ballast car-mounted radio receivers 62. Alternatively, each car 12 may be provided with its own generator.

Figure 6:
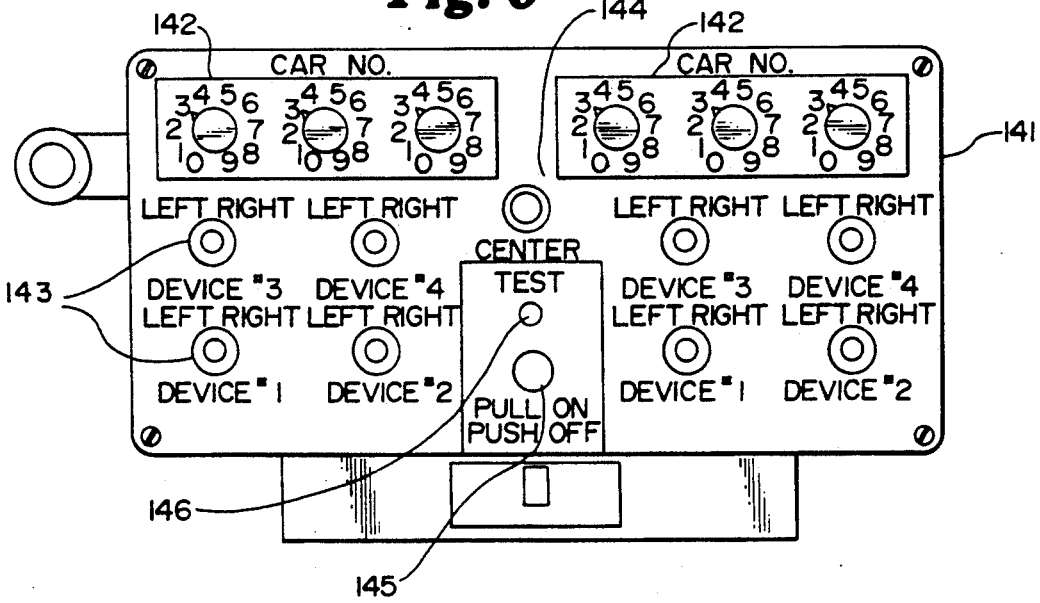
FIG. 6 is a pictorial view of a handheld radio transmitter for use in controlling the position of the ballast hopper discharge doors.

Referring to FIG. 6, a hand held radio transmitter 141 for the semiautomatic, individual control of ballast discharge gate assemblies 38, 40 is depicted. The hand held transmitter 141 includes two car selection modules 142 for dialing in two, three digit car numbers. The transmitter 141 also includes door actuating toggle switches 143 for opening and closing a selected discharge door of a selected car's four doors to either the field or gauge side discharge position. An immediate center switch 144 is provided for immediate closing of a selected discharge door. The transmitter 141 is powered by a battery (not shown), and the transmitter 141 includes a switch 145 and an indicator lamp 146.

Figure 8:
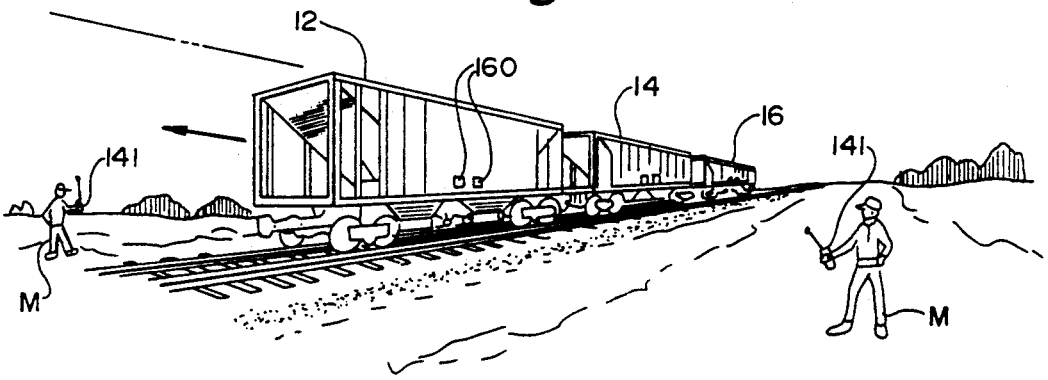
FIG. 8 is a pictorial view depicting the remote actuation of the ballast discharge doors of a plurality of ballast hopper cars with the use of handheld radio transmitters.

Referring to FIG. 8, two handheld transmitters 141 can be operated by two maintenance personnel M stationed on either side of the ballast cars 12, 14, 16 (it being understood that the power car 20, though not shown in FIG. 8, would be included in the ballast train). A three digit number is assigned to each ballast car 12, 14, 16. The maintenance person M dials in the number of the ballast car 12 he desires to operate discharge doors 44 on, and operates the toggle switches 143 to shift the position of desired discharge doors on the selected ballast car. The two transmitters 141 operate on different frequencies to avoid interference between the two maintenance persons M. The single receiver 62 on each car 12, 14, 16 scans the two frequencies and locks on to the first frequency it receives. The transmitted message is coded differently depending on the toggle switch 142 selected by the maintenance man M, and the receiver 62 actuates the appropriate motor 58 to the desired door 44, as selected by the toggle switch 142 keyed by the maintenance man M. Position sensors (not shown) could be placed next to each door 44 to sense the open, closed, or partially open status of each door. The sensed position could be transmitted to the handheld transmitter 141 for display to the maintenance personnel M.

Figure 7:
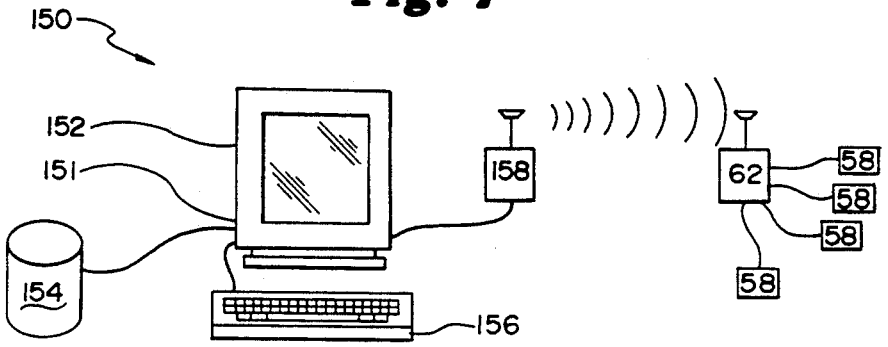
FIG. 7 is a schematic view of a control system in accordance with the present invention.

Referring to FIG. 7, a computer system 150 for the fully automatic control of ballast discharge gate assembly 38, 40 broadly includes a Central Processing Unit (CPU) 151 and information display monitor 152, memory storage 154 for storing computer instructions for the present invention and an input device 156 such as a keyboard. The computer system 150 is mounted in the power car 20, and the computer system 150 is coupled to a power car-mounted transmitter 158 for communication of instructions to the ballast car-mounted receivers 62.

In operation, the ballast distribution, regulation, and reclaiming railroad maintenance device 10 having a computer system 150 for the fully automatic control of ballast discharge is transported to a portion of the railway road bed B requiring additional ballast, and operated at a slow speed in a forward direction as indicated by the arrow in FIG. 1. The computer-directed ballast control system 150 calculates the volume of ballast to be unloaded along the railway road bed in response to an operator entering the desired depth of additional ballast. The computer-directed ballast control system 150 then operates the radio transmitter 158 to actuate the opening of front and rear ballast gates 28, 30 of selected ballast cars 12, 14, 16 to deposit the required amount of ballast onto the railway road bed B, and diagnoses any problems during this process. Operation of the computer-directed ballast control system 150 is depicted in flow chart form in FIGS. 9–18.

Referring to FIG. 9, the operator of the system 150 first determines how much ballast to discharge on to the railroad track bed B (step 200). The system 150 verifies the initialization of the physical components of the system (step 202). Next, the system 150 determines which gates 28, 30 to open in order to maintain desired ballast flow rate (step 204). The system 150 transmits instructions for the selected gate or gates 28 of the selected ballast car or cars 12, 14, 16 via radio transmitter 158 (step 206). The motor 58 and worm gear 60 on the discharge gate 28 responds to the instructions by opening, closing, or adjusting the gate 28 (step 208). The system 150 then checks the flow of ballast through the gate 28 (step 210). Next, the system 150 performs a system-wide check for any problems with the ballast gates 28, 30 (step 212). If there are problems with the discharge of ballast, then the system 150 initiates problem-solving sequences (step 214). If there are no problems with the discharge of ballast, then the system 150 tests whether all the ballast has been discharged (step 216). If all the ballast has not been discharged, the system 150 repeats steps 204–216 until the desired volume of ballast has been unloaded. Once the desired volume of ballast has been discharged, the system 150 closes all open discharge gates 28 (step 215) and the routine ends (step 217).

Figure 10:
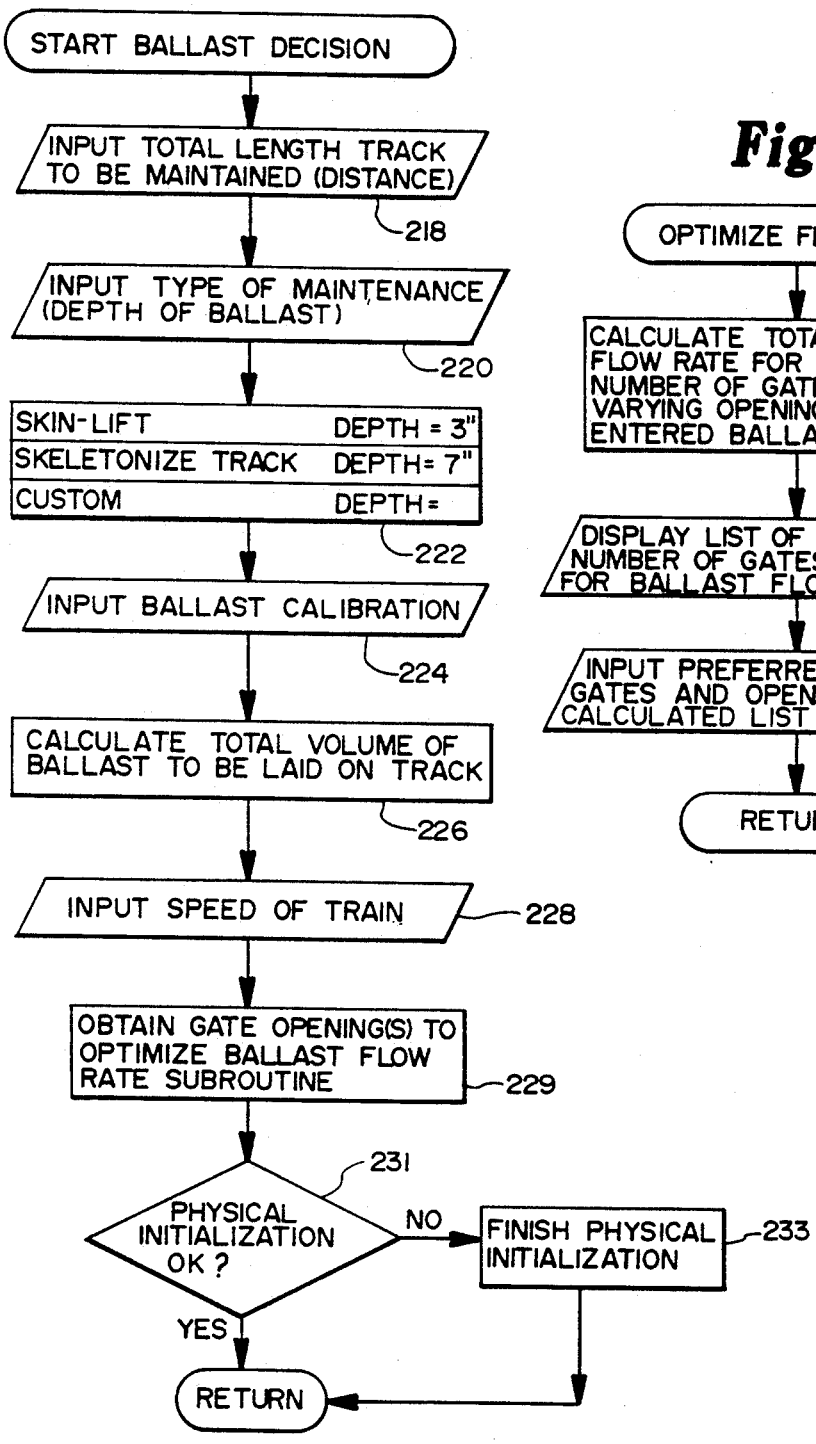
FIG. 10 is a flow chart depicting in greater detail the determination of ballast needed step 200 of FIG. 9.

FIG. 10 depicts the operation of the determine ballast to discharge step 200 in detail. The operator first enters the total length of rail R to be maintained (step 218). The operator next inputs the depth of the ballast to be discharged (step 220). In this regard, the desired operation may be a so called "skin-lift" wherein the track is raised approximately three inches, or the operation may be a refurbishment of a skeletonized track bed B wherein nearly all of the ballast is replaced, or thirdly, the operation may be a so called "custom" operation wherein the depth of the ballast added to the bed B is determined as a function of the pre-existing track condition. The operator next enters the ballast calibration, i.e. the size and type (e.g. granite, limestone, taconite tailings) of the stones that will be used as ballast (step 224).

The system 150 calculates the total volume of ballast to be laid on the track bed B (step 226). The operator enters the speed of the railroad maintenance device 10 (step 228). Next the system 150 determines the optimum number of gate openings and which gates 28, 30 to open to maintain the desired ballast flow rate (step 229). The system 150 verifies whether the physical initialization step 202 is complete (step 231). If not, the system 150 waits until the physical initialization step 202 is complete (step 233).

Figure 11:
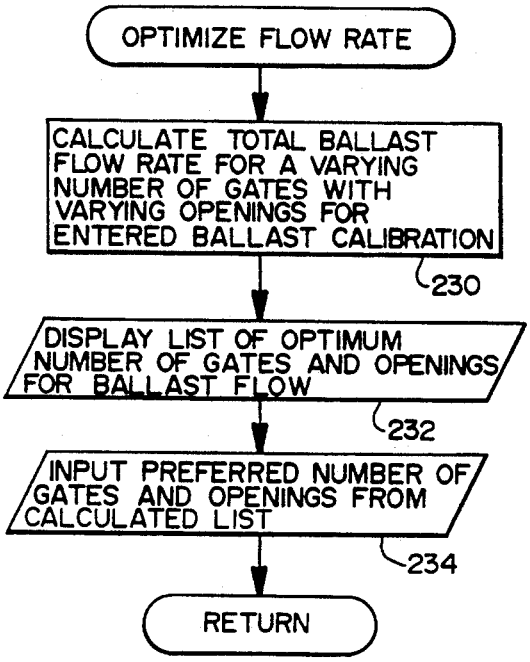
FIG. 11 is a flow chart depicting in greater detail the optimize ballast flow rate step 229 of FIG. 10.

The optimize ballast flow rate step 229 of FIG. 10 is set out in greater detail in FIG. 11. The system 150 first calculates the optimum ballast flow rate through a plurality of gates 28 within the following parameters: the number of ballast cars in the train, the total number of operable ballast gates 28, the size of the ballast gate openings, the approximate ballast flow rates as the gate openings vary from fully open to closed, the volume of ballast available in each car, the desired volume of ballast to be discharged on to the track bed B, the length of the track bed B to be maintained, the distance between the discharge gates 28, the calibration (size) of the ballast stones, the speed of the railroad maintenance device 10, the number of communication paths available between the transmitter 158 and receivers 62 and available manpower (step 230). The speed of the train can be continuously monitored and adjusted during operations to adjust the overall flow rate of ballast through the opened discharged doors. It will be appreciated that, given a particular flow rate, the depth of ballast deposited on to the track bed B is a function of train speed.

The system 150 then displays a list of the more efficient combinations ranked from most efficient to least efficient (step 232). The system 150 classifies combinations as more or less efficient based on the number of active gates 28, i.e. open and discharging ballast, and the degree of each active gate's opening at any given time. The most efficient combinations have the least number of active gates 28 and the gates 28 are open to the fullest degree. These combinations are most efficient because the number of available communication paths between transmitter 158 and receiver 62 limits the number of gates 28 that can be contacted and controlled at any given time and opening gates 28 to the fullest degree discharges the maximum amount of ballast in the shortest amount of time. The operator next chooses the gates 28 to open and the corresponding degree of opening from the list displayed (step 234).

Figure 12:
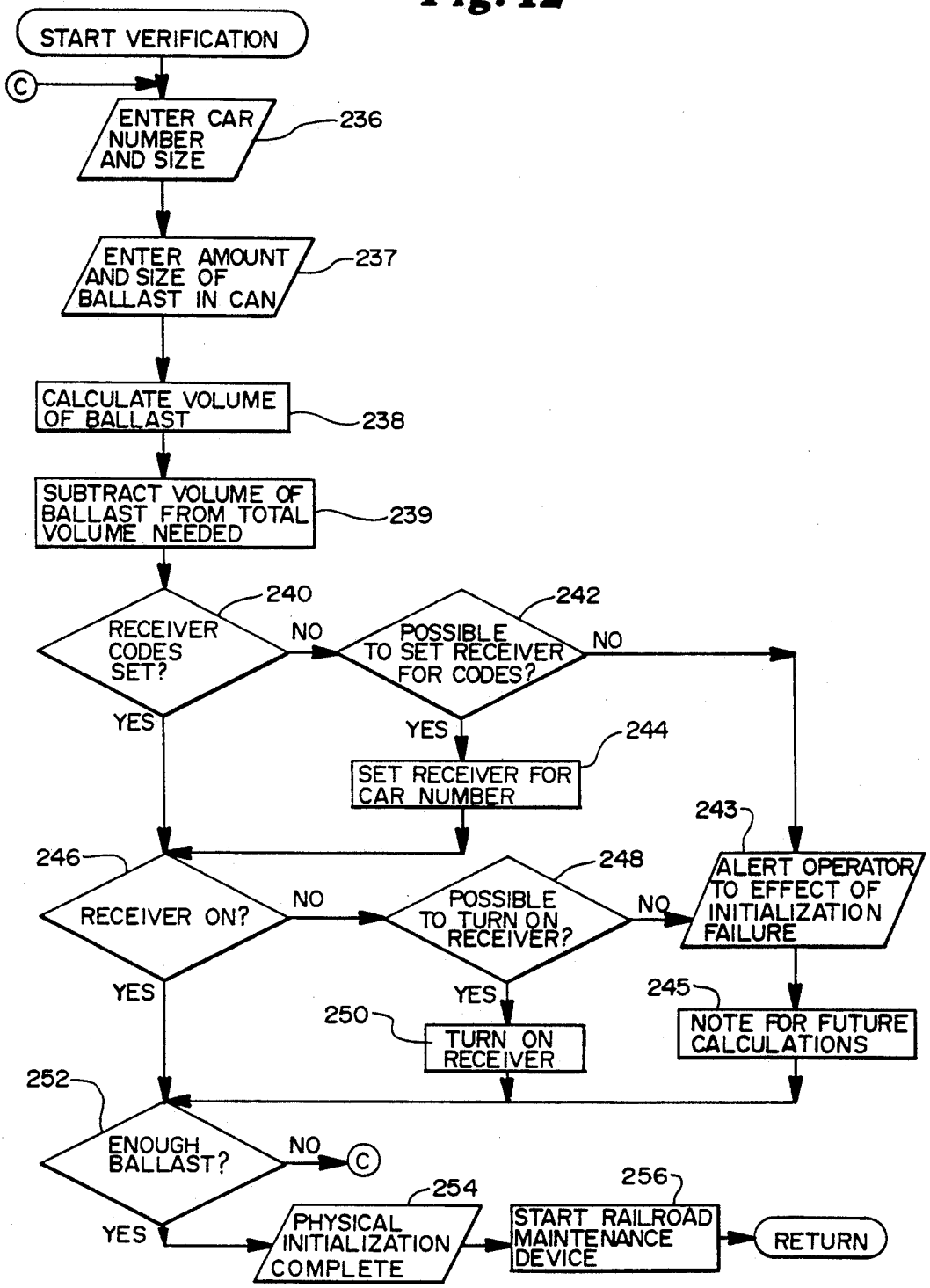
FIG. 12 is a flow chart depicting in greater detail the physical initialization step 202 of FIG. 9.

The physical verification step 202 of FIG. 9 is set out in greater detail in FIG. 12. The physical verification step 202 of FIG. 9 requires the operator to verify that the railroad maintenance device 10 includes the total volume of ballast required for discharge. First, the operator enters each ballast car 12, 14, 16 number or code and the size of ballast car (step 236). The operator next enters the amount of ballast and general size of ballast stones in each car 12, 14, 16 into the computer system (step 237). Alternatively, each car 12, 14, 16 can be provided with a load cell (not shown) that automatically measures the weight of ballast in the individual cars, and transmits the weight measurement to the system 150. This information is entered for each car 12, 14, 16 beginning with the first car 12 that will approach the railway track bed B to be maintained and ending with the last car 16 that will pass over the track bed B. The system 150 calculates the volume of ballast (step 238). The system 150 subtracts the volume of ballast in the car 12 from the total volume of ballast needed to maintain the desired flow rate (step 239) in order to determine if more ballast cars are needed in step 252. The system 150 verifies that the radio receiver 62 for the selected ballast car is set to the unique code for that car by asking the operator for verification (step 240). If the receiver 62 has not been set with the selected car's unique codes, the system 150 asks the operator if the receiver 62 can be set (step 242). If the receiver 62 can be set with the selected car's unique codes, the system 150 waits for the operator to set it 62 (step 244). If the operator cannot set the unique codes for the selected car, the system 150 alerts the operator that the selected car will not be activated during ballast distribution (step 243) and the system 150 notes the position of the selected car for calculating the distance between discharge gates (step 245).

The system 150 verifies whether the radio receiver 62 is operational by asking the operator to confirm that the receiver 62 is turned on (step 246). If the receiver 62 is not on, the system 150 asks whether the receiver 62 could be turned on (step 248). If the receiver 62 can be turned on, the system 150 waits for the operator to do so (step 250). If the operator cannot turn on the receiver 62 for the selected car, the system 150 alerts the operator that the selected car will not be activated during ballast distribution (step 243) and the system 150 notes the position of the selected car for calculating the distance between discharge gates (step 245).

The system 150 determines whether the volume of ballast in the cars 12, 14, 16 entered into the computer system 150 is sufficient to maintain the desired flow rate (step 252). If more ballast is needed, the system 150 repeats the process from step 236 through step 252 until the volume of ballast in the individual cars 12 meets or exceeds the total amount of ballast needed to maintain the track bed B. When the volume of ballast in the cars 12, 14, 16 entered into the computer system 150 is sufficient to maintain the desired flow rate, the system 150 informs the operator that the physical verification step is complete (step 254) and the operator starts the railroad maintenance device 10 (step 256). The exact number of ballast cars required to discharge ballast on to a railway track bed B to the desired depth is a function of the desired depth of ballast, the length of the track B to be maintained, the size of the ballast stones, the amount of ballast carried by each car 12 and the desired speed of the railroad maintenance device 10.

Figure 13:
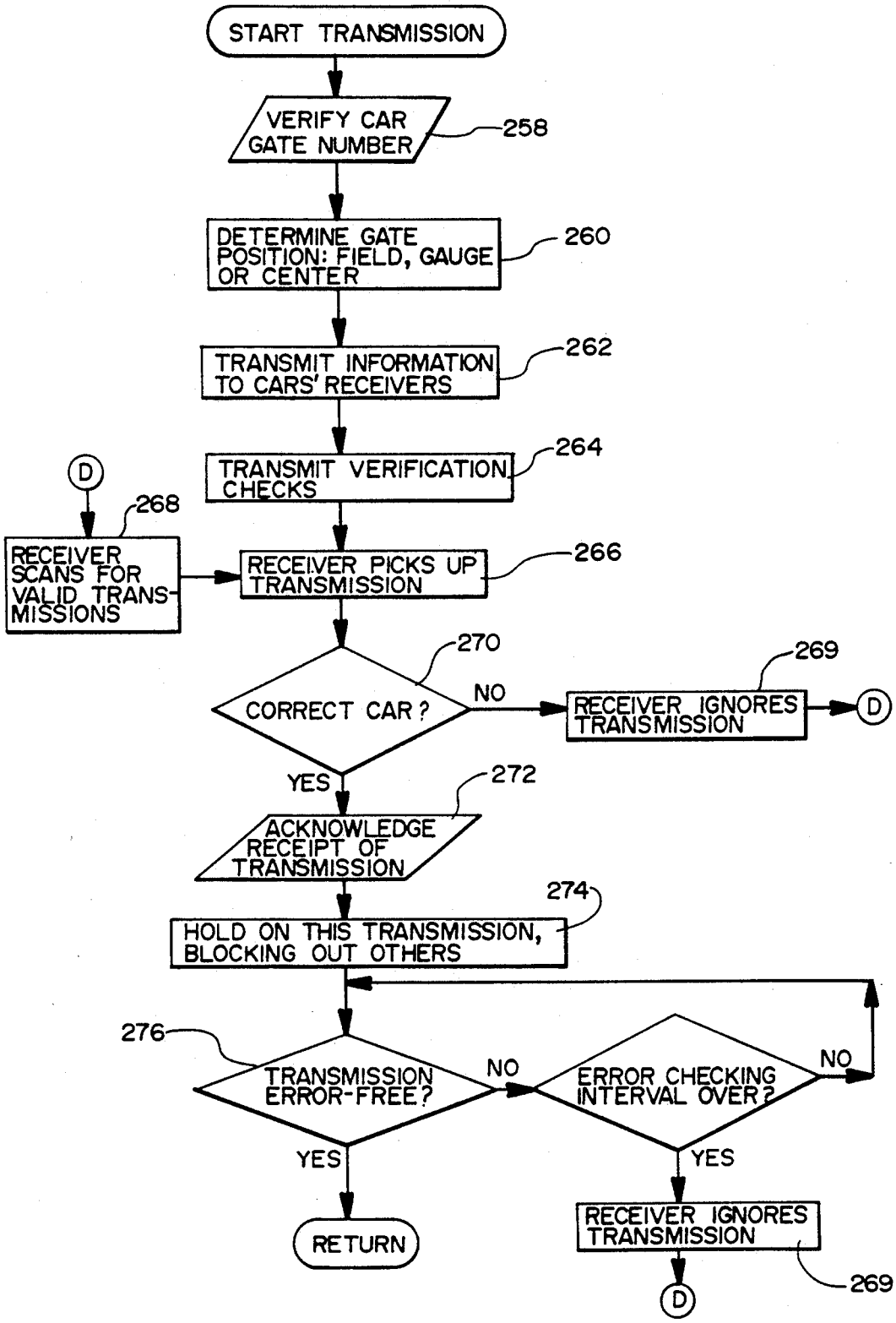
FIG. 13 is a flow chart depicting in greater detail the transmission step 206 of FIG. 9.

The transmit gate instructions step 206 of FIG. 9 is set out in greater detail in FIG. 13. FIG. 13 begins with the operator verifying the number of the selected ballast car or cars and the number of the gate or gates 28 to be activated on the selected car (step 258). Selection of the position of individual gates 28 to discharge ballast to the field side or to the gauge side of the rail R or to the center of the bed is made (step 260). The system 150 transmits that information to the selected car's radio receivers 62 (step 262). The system 150 transmits verification checks as the last part of the transmission (step 264).

The radio receivers 62 on the cars 12, 14, 16 pick up the transmission (step 266). If the received transmission codes match the car number codes, the radio receiver 62 acknowledges receipt of the transmission to the operator (step 272) and locks onto the transmission, blocking out other transmissions (step 274). If the received transmission codes do not match the car number codes, then the receiver 62 ignores the transmission (step 269) and continues to scan for valid transmissions (step 268).

The radio receiver 62 checks whether the transmission is error-free using the verification checks that were sent earlier (step 276). If the transmission is not error-free, the receiver 62 rechecks the transmission to verify the transmission (step 278). If the transmission is still not error-free (step 276, 278), the receiver 62 ignores the transmission (step 269) and continues scanning for a valid transmission (step 268).

Figure 14:
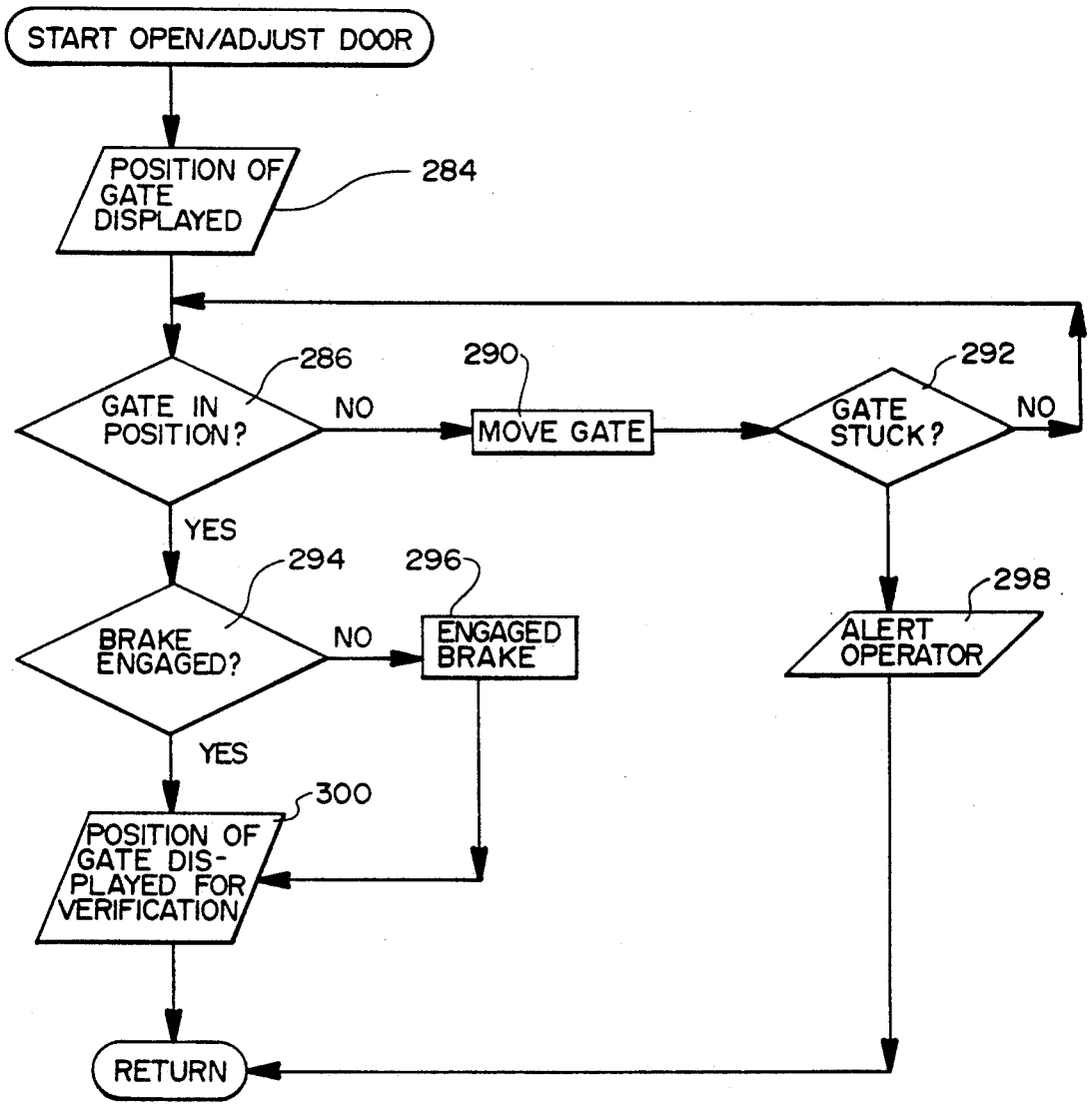
FIG. 14 is a flow chart depicting in greater detail the open or adjust door step 208 of FIG. 9.
Figure 15:
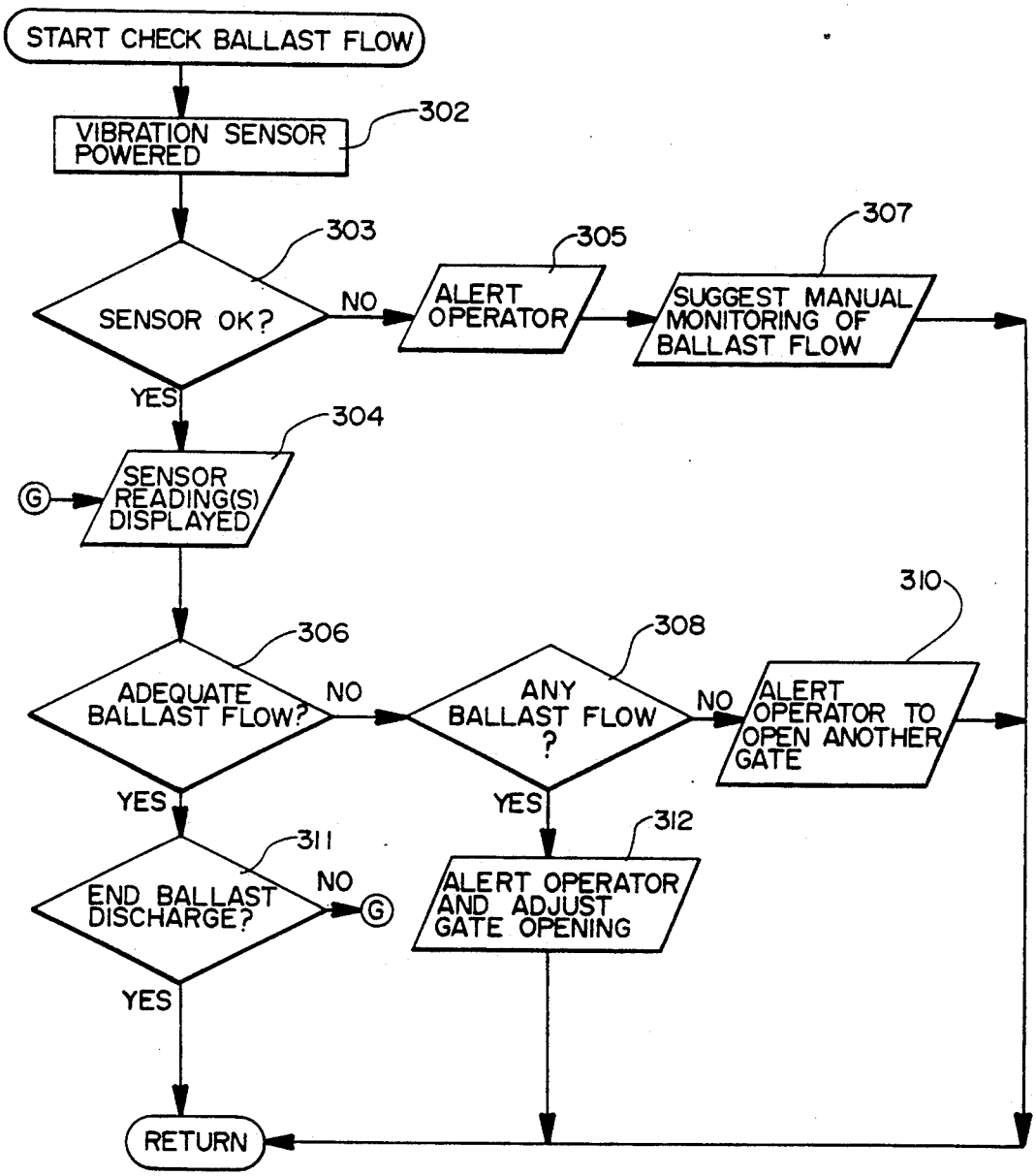
FIG. 15 is a flow chart depicting in greater detail the check ballast flow step 210 of FIG. 9.

Opening and adjusting a gate step 208 of FIG. 9 is set out in greater detail in FIG. 14. In FIG. 14, the current position of the door 44 is displayed to the operator (step 284). If the current door position is not the requested door position (step 286), the system 150 powers the motor 58 and the gears 60 to move the door 44 into the requested position (step 290).

The system 150 checks whether the door 44 can move into the requested position (step 292). Occasionally, ballast may become wedged between the gate opening 42 and the door 44, blocking the door 44 from pivoting and closing the gate opening 42. The system 150 identifies when ballast blocks the door 44 from pivoting freely and alerts the operator (step 298). If ballast does not block the door 44 and the door 44 is not in the requested position, then the system 150 continues to power the motor 58 and the gears 60 to pivot the door 44 into position (step 290). Once the door 44 is in position, the system 150 checks whether the door brake is engaged (step 294), holding the door 44 in place. If the door brake is not engaged, the system 150 applies the brake to prevent the door 44 from moving any further (step 296). The position of the door 44 again is displayed to the operator so the operator may verify the position of the door 44 (step 300).

Once the discharge door 44 is in position, the system 150 checks whether the ballast flow rate is consistent with the door position (step 210). The check ballast flow step 210 of FIG. 9 is set out in greater detail in FIG. 15. First, the vibration sensor 45 is activated (step 302). Next, the system 150 checks that the sensor 45 is working (step 303). If the sensor 45 is not working, the system 150 alerts the operator (step 305) and suggests a manual monitoring of the ballast flow (step 307).

If the sensor 45 is working, sensor readings are communicated to the operator (step 304). The system 150 then checks whether the ballast flow rate is adequate (step 306). The ballast flow is adequate when the ballast flow is consistent with the door position. For example, if the door 44 is in a fully open position, the ballast flow rate should be very positive. If the door 44 is in a fully closed position, the ballast flow rate should be at or near zero. If the ballast flow is adequate, the system 150 determines whether to end the discharge of ballast (step 311). The system 150 will end the discharge of ballast if instructed to close the discharge door 44 or if all the ballast has been discharged. If the system 150 does not end the discharge of ballast, the system 150 continues to display the sensor readings to the operator (step 304).

If the ballast flow is inadequate, the system 150 checks whether there is any ballast being discharged at all (step 308). If no ballast is being discharged, the system 150 alerts the operator and opens another discharge door 44 (step 310). If the sensor 45 shows a significantly higher or lower ballast flow rate than the desired flow rate, the system 150 alerts the operator and opens or closes the door 44 to obtain the desired flow rate.

The system 150 then reviews the process to highlight any ongoing problems (step 212 of FIG. 9). If there are problems, the system 150 initiates problem solving (step 214). The problem solving step 214 of FIG. 9 is set out in greater detail in FIG. 16.

One problem the system 150 might encounter is the failure of a door 44 to pivot and move freely to close or open a gate 28. The system 150 verifies whether all active gates can move freely (step 314). If any doors cannot pivot freely, the system 150 determines that making incremental changes in the position of the door 44 should correct this problem (step 315). The system 150 transmits incremental changes in the position of the door 44 moves (step 316). The system 150 moves the door 44 slightly to loosen any ballast that might be blocking the door's movement (step 317). The system 150 verifies that the door 44 moves freely (step 318). If the door 44 is not moving freely after three attempts (step 319), the system 150 applies the brake (step 320) to lock the door 44 in place before re-calculating the ballast flow without the use of this gate.

The system 150 verifies whether the flow of ballast is adequate through all the active gates 28 (step 321). If the ballast flow is inadequate, the system 150 verifies whether any ballast is being discharged at all (step 322). If no ballast is being discharged, the system 150 alerts the operator (step 324). The system 150 determines that the solution to the absence of ballast is to open a gate with a full hopper 30 to replace the gate with an empty hopper 28 (step 325). The system 150 transmits instructions to open another gate (step 206). The system 150 opens the new gate (step 208) and verifies the ballast flow rate through the new gate (step 210). If an inadequate amount of ballast is being discharged, the system 150 alerts the operator (step 326) and determines that the solution to inadequate ballast flow is to adjust the gate opening (step 327). The system 150 then transmits instructions to adjust the gate opening (step 206), adjusts the gate opening (step 208) and verifies the new ballast flow rate through the adjusted opening (step 210).

The system 150 also verifies whether the transmitter 158 is operational (step 328). If the transmitter 158 is not operational, the system 150 alerts the operator and suggests the operator follow the manual transmitter override routine (step 330). The system 150 displays the transmitter override procedure (step 332).

The system 150 also verifies whether the motor 58 is receiving power in order to move the door 44 (step 334). If there is no power to the motor 58, the system 150 alerts the operator and suggests the operator follow the manual gate override routine (step 336). The system 150 displays the gate override procedure (step 338).

If the system 150 cannot identify the problem (step 340), the system 150 will alert the operator and suggest the operator stop the railroad maintenance device 10 (step 344). In this regard, it will be appreciated that all doors would be programmed to fail in the closed position, and stopping the train would automatically cause all ballast doors to close. If there are no problems, the system 150 assumes everything is functioning properly (step 342) and continues the routine.

Figure 16:
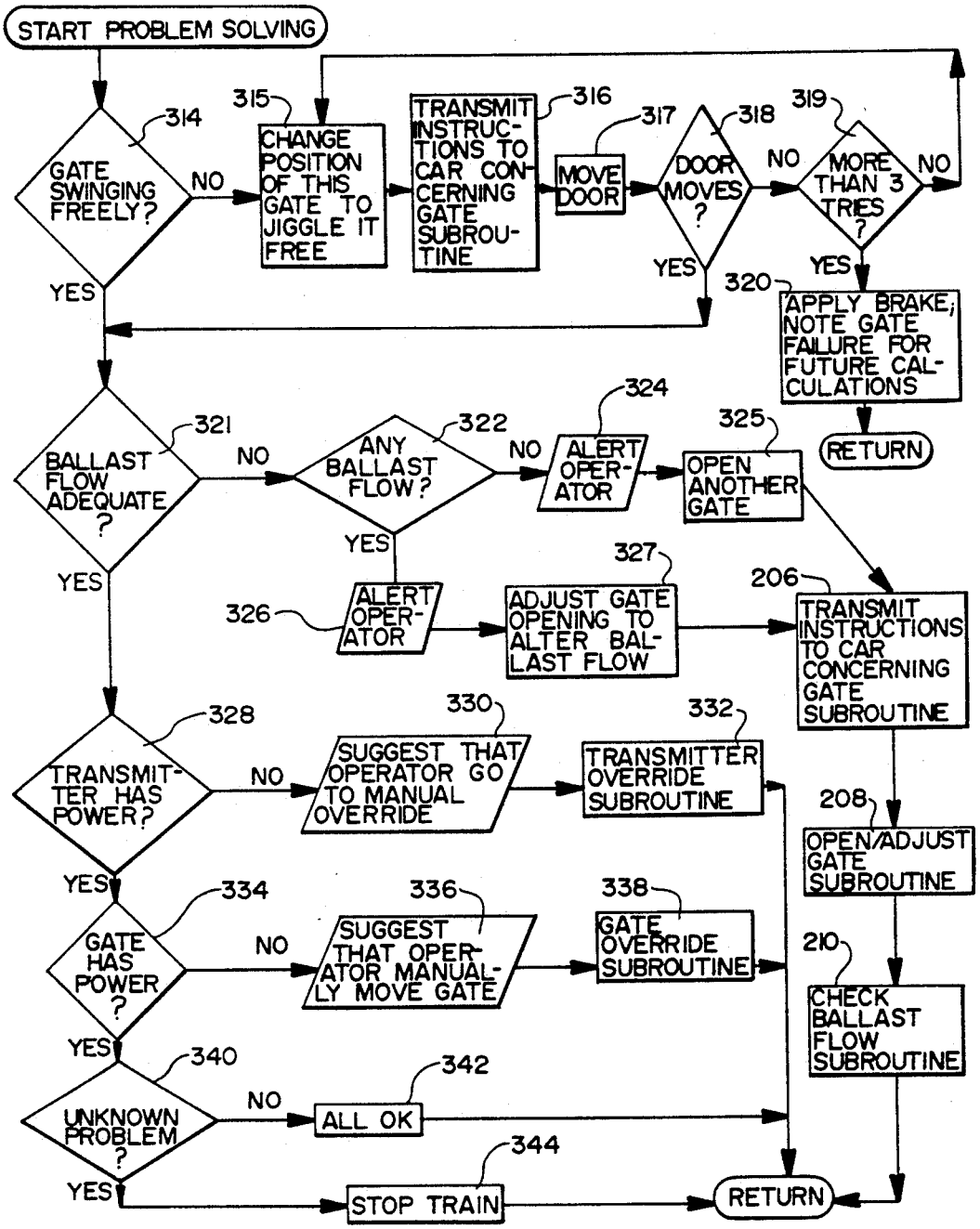
FIG. 16 is a flow chart depicting in greater detail the problem solving step 214 of FIG. 9.
Figure 17:
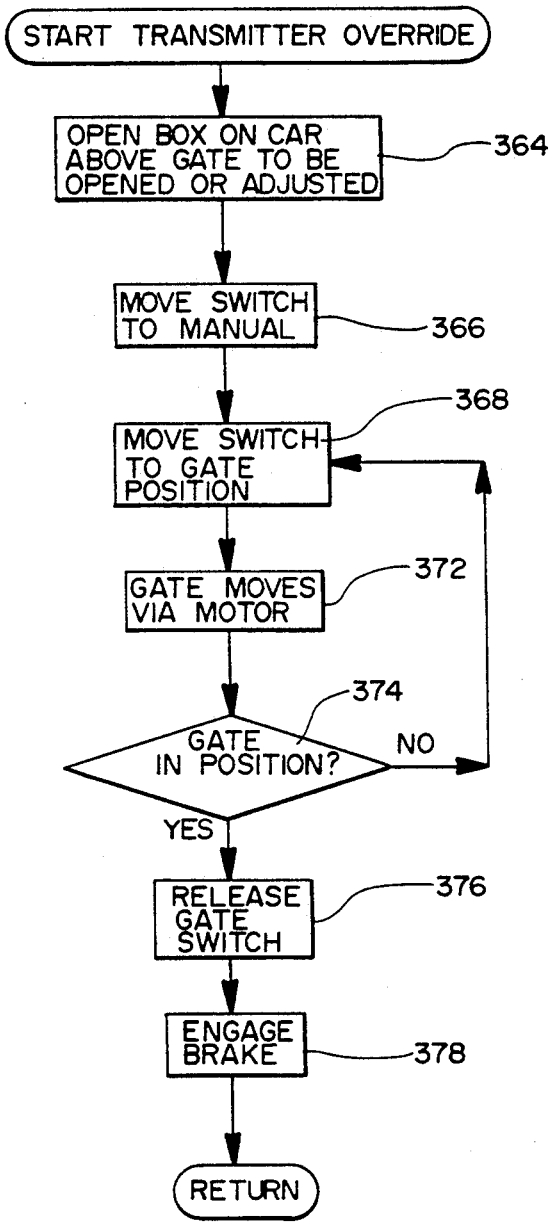
FIG. 17 is a flow chart depicting in greater detail the transmitter override step 332 of FIG. 16.

The transmitter override step 332 of FIG. 16 is set out in greater detail in FIG. 17. First, the operator must open the override compartment 160 located above the door 44 to be manually operated (step 364). The operator moves the transmitter switch 162 to a manual position (step 366) and moves the door switch 164 to a position corresponding with the desired door position (step 368). The system 150 powers the motor 58 and the gears 60 to move the door 44 into position (step 372). The system 150 verifies whether the door 44 is in position (step 374). Once the door 44 is in position, the operator releases the door switch 164 (step 376) and applies the door brake (step 378).

Figure 18:
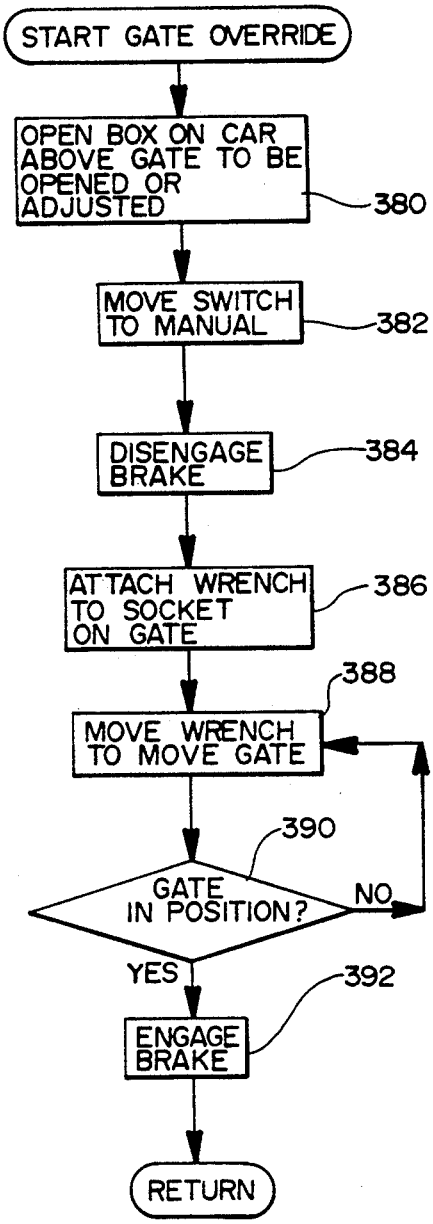
FIG. 18 is a flow chart depicting in greater detail the ballast door override step 338 of FIG. 16.

The door override step 338 of FIG. 16 is set out in greater detail in FIG. 18. First, the operator must open the override compartment 160 located above the door 44 to be manually operated (step 380). The operator moves the transmitter switch 162 to a manual position (step 382) and moves the lever 57 disengaging the door brake (step 382). The operator attaches a hand crank (not shown) to the end of the motor shaft 59 (step 386) and moves the door 44 (step 388). The operator continually checks whether the door 44 is in the desired door position (step 390). If the door 44 is not in position, the operator moves the hand crank again (step 388). Once the door 44 is in position, the operator engages the brake (step 392).

The volume of ballast deposited on bed B can be calculated upon completion of the operation through a direct reading of the weight of the remaining ballast in the cars by the load cells (not shown). Alternatively, the volume of ballast deposited can be indirectly calculated by multiplying the flow rates for each gate by the amount of time each gate was operated.

The reclaim wing plows 68, 70 of the regulating and reclaim car 18 may be extended outwardly and positioned along the ground so that, as the device 10 transmits forwardly, ballast spaced apart from the road bed can be pushed onto the road bed for reclaiming by the track regulator 72. In this regard, it will be appreciated that the ballast captured by the reclaim wing plows 68, 70 could typically be ballast left during a previous ballast distribution operation, and formed into windrows due to the inability of prior art devices to reclaim excess ballast.

As the device 10 continues to move forwardly, the ballast brought into proximity of the railway road bed B by the reclaim wing plows 68, 70 is captured by the track regulator 72, and deposited along the center line of the railway road bed B. The door 120 to the opening 112 of the bucket elevator housing 110 may be opened to receive excess ballast deposited by the track regulator along the center line of the railway road bed B. The buckets 116 capture and lift the excess ballast to the discharge chute 114 of the bucket elevator housing 110. The ballast discharged from the bucket elevator 80 is received onto endless web 122 of belt conveyor 82, and is transported by the belt conveyor 82 to the ballast hopper car 16. Load cells (not shown) within the car 16 provide a measure of the weight of ballast within the car 16 to the computer system 150.

The right and left shoulder regulators 76, 78 capture ballast in the vicinity of the shoulder of the railway road bed, on the field side of each of the rails, that is not captured by the track regulator 72. The ballast captured by the right and left shoulder regulator 76, 78 is smoothed and distributed along the shoulder of the railway road bed B.

We claim:

1. A railroad maintenance system for distributing ballast at any point along a railroad track bed while said system transits along said railroad track bed, comprising:

a plurality of ballast cars operably coupled together and to a self-powered motive car into a ballast train, each of said ballast cars including rail engaging wheels for supporting said respective ballast cars along said railroad track bed, each of said ballast cars further including a plurality of ballast hoppers, and each of said hoppers having a lowermost ballast door shiftable between a closed position wherein ballast can be retained within said respective hoppers, and an open position wherein ballast carried within said respective ballast hoppers can exit through said respective ballast doors on to said railroad track bed;

drive means operably coupled to each of said ballast doors for shifting said respective ballast doors between said open and closed positions;

actuating means operably coupled to each of said drive means for selectively actuating said respective drive means for shifting of said respective ballast doors;

radio frequency receiver means operably coupled to respective ones of said drive means for selectively providing said respective drive means with actuation signals for operating said respective ballast doors of said respective ballast hoppers;

radio frequency transmitter means for selectively transmitting a coded radio frequency command signal to said receiver means for initiating said actuation signals whereby selected ones of said ballast doors of selected ones of said ballast cars can be selectively remotely actuated for shifting between said closed and said open positions, such that ballast from selected hoppers from selected cars can be remotely, alternately deposited at any selected portion along said roadbed while said ballast train transits along said railroad track bed; and control means operably coupled to said actuating means for coordinating the positions of said plurality of ballast doors to control the discharge of ballast from said system at a predetermined optimum ballast flow rate while said ballast train transits along said railroad track bed, said control means including means for establishing said predetermined optimum ballast flow rate based on the number of ballast cars in said system, the amount of ballast in each of said cars, the amount of ballast desired to be deposited along said road bed, the size and number of operable ballast doors, the length of the road bed to be maintained, the distance between ballast doors, and the size of the ballast to be deposited.

2. The invention as claimed in claim 1, said transmitter means comprising a plurality of radio frequency transmitters for transmitting respective command signals, each of said command signals including identification criteria for indicating from which of said radio frequency transmitters the command signal was transmitted, said radio frequency receiver means including scanning means for receiving command signals from only one of said transmitters at a time.

3. The invention as claimed in claim 1 including control means operably coupled to said actuating means for coordinating the positions of said plurality of ballast doors to control the discharge of ballast from said system at a predetermined optimum ballast flow rate while said ballast train transits along said railroad track bed.

4. The invention as claimed in claim 1, including an individual radio frequency receiver means carried by each of said ballast cars, said radio frequency transmitter means including means for selecting individual ones of said radio frequency receiver means for receipt of said coded radio frequency command signal.

5. A railroad maintenance system for distributing ballast at any point along a railroad track bed while said system transits along said railroad track bed, comprising:

a plurality of ballast cars operably coupled together and to a self-powered motive car into a ballast train, each of said ballast cars including rail engaging wheels for supporting said respective ballast cars along said railroad track bed, each of said ballast cars further including a plurality of ballast hoppers, and each of said hoppers having a lowermost ballast door shiftable between a closed position wherein ballast can be retained within said respective hoppers, and an open position wherein ballast carried within said respective ballast hoppers can exit through said respective ballast doors on to said railroad track bed;

drive means operably coupled to each of said ballast doors for shifting said respective ballast doors between said open and closed positions;

actuating means operably coupled to each of said drive means for selectively actuating said respective drive means for shifting of said respective ballast doors;

radio frequency receiver means operably coupled to respective ones of said drive means for selectively providing said respective drive means with actuation signals for operating said respective ballast doors of said respective ballast hoppers;

radio frequency transmitter means for selectively transmitting a coded radio frequency command signal to said receiver means for initiating said actuation signals whereby selected ones of said ballast doors of selected ones of said ballast cars can be selectively remotely actuated for shifting between said closed and said open positions, such that ballast from selected hoppers from selected cars can be remotely, alternately deposited at any selected portion along said roadbed while said ballast train transits along said railroad track bed; and control means operably coupled to said actuating means for coordinating the positions of said plurality of ballast doors to control the discharge of ballast from said system at a predetermined optimum ballast flow rate while said ballast train transits along said railroad track bed, said control means including means for establishing said predetermined optimum ballast flow rate based on the number of ballast cars in said system, the amount of ballast in each of said cars, the amount of ballast desired to be deposited along said road bed, the size and number of operable ballast doors, the length of the road bed to be maintained, the distance between ballast doors, and the size of the ballast to be deposited and means for determining the amount of ballast in each of said ballast cars.

6. The invention as claimed in claim 4, said means for determining the amount of ballast in each of said ballast cars comprising load cells in each of said ballast cars.

7. The invention as claimed in claim 5, said control means including means for confirming the flow of ballast from ballast cars designated by said control system to have open ballast doors for the deposition of ballast along said road bed.

8. The invention as claimed in claim 6, said means for confirming the flow of ballast from ballast cars comprising vibration sensors.

* * * * *

UNITED STATES PATENT AND TRADEMARK OFFICE

CERTIFICATE OF CORRECTION

PATENT NO. : 5,284,097

DATED : February 8, 1994

INVENTOR(S) : Richard A. Peppin et al.

It is certified that error appears in the above-identified patent and that said Letters Patent is hereby corrected as shown below:

Column 5, line 16, delete the word "cap" and substitute therefor --car--.

Column 14, line 23, delete the number "4" and substitute therefor --5--.

Column 14, line 26, delete the number "5" and substitute therefor --6--.

Column 14, line 31, delete the number "6" and substitute therefor --7--.

Signed and Sealed this

Second Day of August, 1994

*Attest:*

Bruce Lehman

BRUCE LEHMAN

*Attesting Officer*

*Commissioner of Patents and Trademarks*